US010323604B2

(12) United States Patent
Wood

(10) Patent No.: US 10,323,604 B2
(45) **Date of Patent: *Jun. 18, 2019**

(54) FREE PISTON STIRLING ENGINE THAT REMAINS STABLE BY LIMITING STROKE

(71) Applicant: Sunpower, Inc., Athens, OH (US)

(72) Inventor: James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 137 days.

This patent is subject to a terminal disclaimer.

(21) Appl. No.: 15/494,909

(22) Filed: Apr. 24, 2017

(65) Prior Publication Data

US 2018/0112625 A1 Apr. 26, 2018

Related U.S. Application Data

(60) Provisional application No. 62/410,987, filed on Oct. 21, 2016.

(51) Int. Cl.
*F02G 1/043* (2006.01)

(52) U.S. Cl.
CPC ..... *F02G 1/0435* (2013.01); *F02G 2243/202* (2013.01); *F02G 2270/80* (2013.01)

(58) Field of Classification Search
None
See application file for complete search history.

(56) References Cited

U.S. PATENT DOCUMENTS 4,183,214 A * 1/1980 Beale ..... F02G 1/0435 60/520
7,168,248 B2 * 1/2007 Sakamoto ..... F02G 1/0435 60/517
8,590,301 B2 * 11/2013 Wood ..... F02G 1/0435 60/518
2001/0042373 A1 * 11/2001 Bliesner ..... F02G 1/043 60/517
2001/0049938 A1 * 12/2001 Urasawa ..... F02G 1/043 60/517

(Continued)

FOREIGN PATENT DOCUMENTS

WO 2006/067429 A1 6/2006

*Primary Examiner* — Mark A Laurenzi
*Assistant Examiner* — Shafiq Mian
(74) *Attorney, Agent, or Firm* — Frank H. Foster; Kremblas & Foster

(57) ABSTRACT

A free-piston Stirling engine that limits piston amplitude and reduces engine power as the piston amplitude increases beyond its maximum power. The inward edge of the heat rejecter cylinder port is located outward of the most inward excursion of the inward end of the piston sidewall during a part of the piston's reciprocation cycle so that the heat rejecter cylinder port is entirely covered by the piston sidewall during an inward portion of the piston reciprocation when the engine is operating at the selected maximum engine power. A leaker port extends from a gas bearing cavity through the piston sidewall and is positioned axially outward from the gas bearing pads of the engine's gas bearing system and vents working gas to the engine's back space at a piston amplitude of reciprocation that exceeds the piston's amplitude of reciprocation at maximum engine power. A resilient damping bumper is attached to the outward end of the piston and a displacer gas cushion is disclosed.

3 Claims, 6 Drawing Sheets

(56) References Cited

U.S. PATENT DOCUMENTS

| | | | | |
|---|---|---|---|---|
| 2004/0163388 | A1* | 8/2004 | Yamagiri | F02G 1/043 60/517 |
| 2005/0268604 | A1* | 12/2005 | Takahashi | F02G 1/044 60/517 |
| 2006/0137339 | A1* | 6/2006 | Sakamoto | F02G 1/0435 60/520 |
| 2007/0277521 | A1* | 12/2007 | Tanaka | F02G 1/0435 60/517 |
| 2008/0256945 | A1* | 10/2008 | Welty | F02G 1/0435 60/520 |
| 2008/0282694 | A1* | 11/2008 | Kitamura | F02G 1/0435 60/517 |
| 2009/0039655 | A1* | 2/2009 | Berchowitz | F02G 1/043 290/1 A |
| 2011/0056196 | A1* | 3/2011 | Berchowitz | F02G 1/0435 60/517 |
| 2013/0031899 | A1* | 2/2013 | Budliger | F02G 1/043 60/520 |

* cited by examiner

Fig. 7
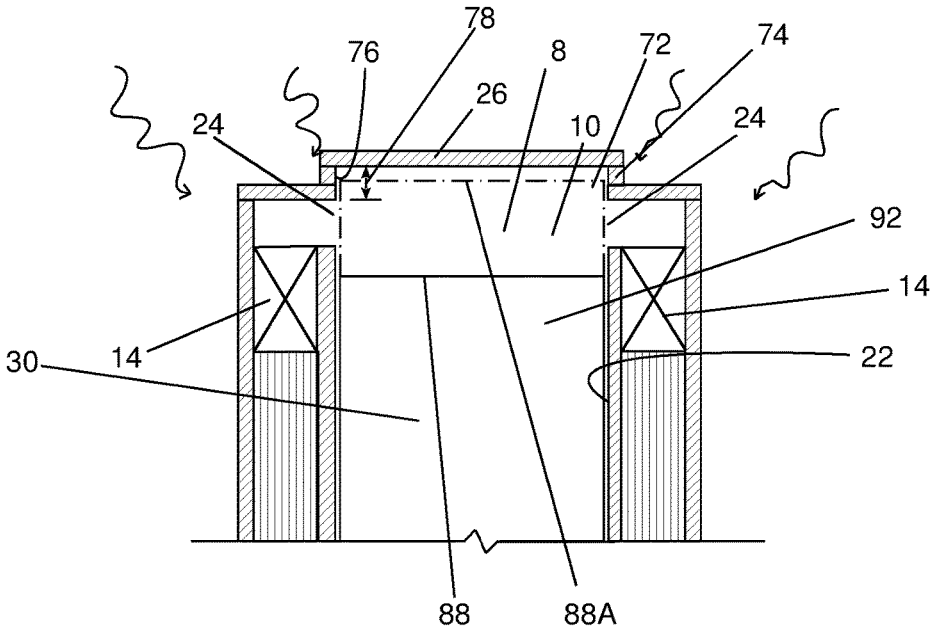
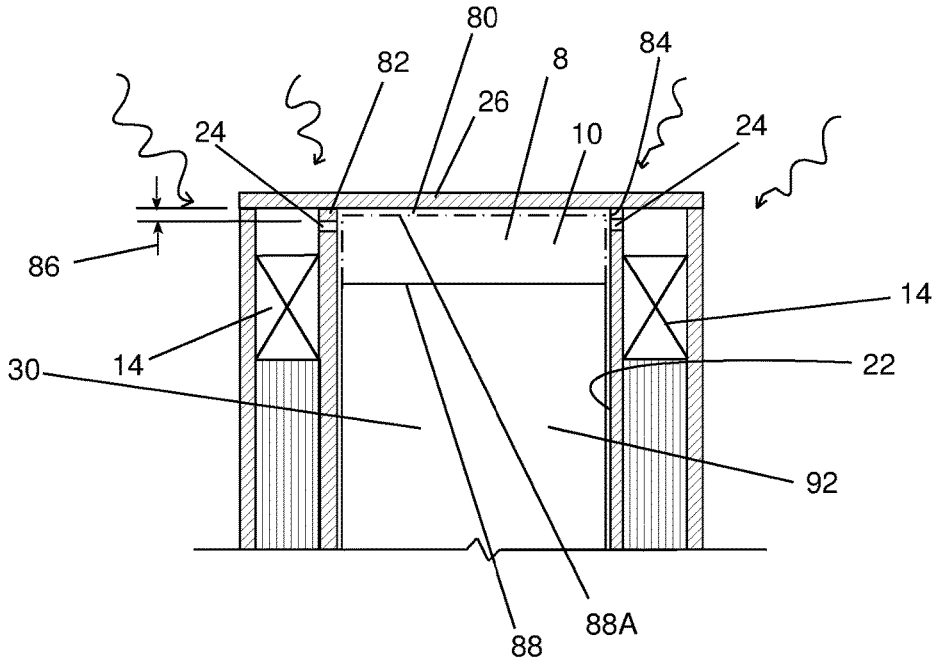
Fig. 8

FREE PISTON STIRLING ENGINE THAT REMAINS STABLE BY LIMITING STROKE

CROSS-REFERENCES TO RELATED APPLICATIONS

This application claims the benefit of U.S. Provisional Application No. 62/410,987 filed Oct. 21, 2016.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates to free-piston Stirling engines (FPSE) and more particularly relates to an improvement which causes the engine to be automatically depowered in the event that the engine load, as seen by the engine at its output, changes in a manner that the engine would become unstable, for example because of a failure of the engine's controller or wiring to the controller. This depowering prevents an increase of piston amplitude of reciprocation that would otherwise cause a runaway amplitude increase resulting in the piston having engine-damaging collisions with other internal engine components.

A problem with free-piston Stirling engines is that historically they have not been tolerant to loss of load. A kinematic Stirling machine that is adequately designed will, when its load is removed or reduced, often just run at a higher speed and the machine's internal heat exchanger pumping losses consume the power produced. However a FPSE is a resonant machine and so, if unloaded, the frequency will not change significantly. Instead, the piston and displacer will over-stroke and collide with physical structures within the engine and with each other. The problem is made worse because the power increases not only with amplitude but also because of the resulting discontinuous motions resulting from collisions. The collisions often lead to failure of internal components and to the generation of debris which can lead to engine failure. The purpose of the invention is to provide a FPSE which is tolerant to loss of engine load because such collisions and damage are prevented by the invention if the engine's load is reduced or becomes zero.

FIG. 1 is a diagrammatic illustration of a beta type free-piston Stirling engine that embodies the invention. However, many of the engine's structural features that are symbolically illustrated in FIG. 1 are known in the prior art. Therefore, those features that an embodiment of the invention has in common with the prior art are described in this "Background of the Invention" section. The distinguishing features of the invention are then described in the other sections.

Referring to FIG. 1, in a Stirling engine a working gas is confined in a working space 8 comprised of a heat accepting expansion space 10, an opposite heat rejecting compression space 12 and a working gas flow path between the expansion space 10 and the compression space 12. The working gas flow path includes, in series fluid connection, a heat acceptor 14, which transfers externally applied heat into the working gas, a heat rejecter 16, which transfers heat out of the working gas, and an interposed regenerator 18. The flow path also includes a heat rejecter cylinder port 20 through an engine cylinder 22 at the cylinder's compression space 12 and a heat acceptor cylinder port 24 at the open end of the engine cylinder 22 at the cylinder's expansion space 10. The heat acceptor 14, heat rejecter 16 and regenerator 18 are formed annularly to surround the engine cylinder 22. The heat rejecter cylinder port 20 consists of several such ports located at intervals that are spaced annularly around the cylinder and in common fluid communication. Heat is applied to the heat acceptor 14 and commonly to the entire head end 26 of the engine, such as by a gas flame or the application of concentrated solar energy. Heat is removed from the heat rejecter 16 by an external heat exchanger (not shown) that transfers the heat to the coolant of a cooling system.

Reciprocating motion of the piston 28 and a displacer 30 cause the working gas to be alternately heated and cooled and alternately expanded and compressed in order to do work on the piston 28 that reciprocates in the cylinder 22. The piston 28 has a sidewall 32 that engages and slides along the cylinder 22 and the sidewall has an inward end 34. The terms "in", "inward", "out" and "outward" are used as a terminology convention to describe the opposite axial directions of motion of engine components including the piston 28 and the displacer 30. The terms "in" and "inward" indicate a direction or position toward or nearer the working space 8, which includes the compression space 12 part of the working space 8. The terms "out" and "outward" indicate a direction or position away from or farther from the working space 8. The piston 28 also has an annular cutout or relieved portion to form a central cap or boss 36 that is unrelated to the invention. Its purpose is to occupy a volume of the compression space 12 which would otherwise be an unswept volume.

The displacer 30 of a beta type Stirling engine typically reciprocates in the same cylinder 22. The displacer 30 is connected through a displacer connecting rod 38 to a planar spring 40 that is mounted to a casing 42. The casing 42 surrounds a relatively large volume back space 43 and also contains working gas. The reciprocating mass of the piston 28, the reciprocating mass of the displacer 30 and its connecting rod acting upon the planar spring 40 and the resiliently compressible and expansible working gas together form a resonant system which has been called a thermal oscillator.

The reciprocating displacer 30 cyclically shuttles the working gas between the compression space 12 and the expansion space 10 through the heat accepter 14, the regenerator 18 and the heat rejecter 16. This shuttling cyclically changes the relative proportion of working gas in each space. Gas that is in the expansion space 10, and gas that is flowing into or out of the expansion space 10 through the heat accepter 14 accepts heat from surrounding surfaces. Gas that is in the compression space 12 and gas that is flowing into or out of the compression space 12 through the heat rejecter 16 rejects heat to surrounding surfaces. The rejected heat is ordinarily transferred away by the cooling system. The gas pressure is essentially the same in both spaces 10 and 12 at any instant of time because the spaces 10 and 12 are interconnected through the working gas flow path between the expansion space 10 and the compression space 12 and that flow path has a relatively low flow resistance. However, the pressure of the working gas in the working space 8 as a whole varies cyclically and periodically. The periodic increase and decrease of the pressure of the working gas in the working space 8 drive both the piston 28 and the displacer 30 in reciprocation. The periodic pressure variations are caused by the resultant of two components that are out of phase with each other. The first component is the alternating net heating and cooling of the working gas in the workspace. When a majority of the working gas is in the compression space 12, there is a net heat rejection from the working gas and the first component of gas pressure variation decreases. When a majority of the working gas is in the expansion space 10, there is a net heat acceptance into the working gas and the first component of gas pressure variation increases. The second component of gas pressure variation is the result of piston motion which alternately compresses and expands working gas in the working space as a consequence of piston motion.

GAS BEARINGS. Because liquid lubricants can foul the heat exchangers or vaporize in the hot regions, Stirling engines are provided with a gas bearing lubrication system. Working gas is cyclically pumped into a gas bearing cavity 44 through a gas bearing inlet passage 46. Although the bearing cavity 44 appears in the drawing as two separate cavities 44A and 44B, the gas bearing cavity 44 is a continuous annular space within the piston. A check valve 48 permits the working space 8 pressure variations in the compression space 12 to pump working gas into the bearing cavity 44 but prevents gas flow in the opposite direction. The working gas within the cavity 44 flows out of the cavity 44 through multiple gas bearing pads 50. The gas bearing pads 50 are chambers that are spaced at annular intervals around the piston with flow restrictive passages into the gas bearing cavity 44. Consequently, the interfacing surfaces of the piston 28 and the cylinder 22 are lubricated, and the piston is centered, by the flow of the pressurized working gas from the gas bearing pads 50 into the small clearance gap between those interfacing surfaces and then into the working space 8 and the back space 43.

CENTERING SYSTEM. FPSEs typically have a net flow of gas over the cycle from the working space to the back space. One cause is that gas passage through the piston/cylinder clearance gap has a net flow in the out direction. The reason is that, although the volume of gas flow is the same in both directions, the density of gas flowing out of the workspace is larger than the density of gas flowing into the workspace. The density is larger because the pressure of gas in the workspace, when gas flows out of the workspace, is greater than the pressure of gas in the back space when gas flows out of the back space. More importantly, for machines with gas bearings, the bearings tend to pump gas out of the working space to the back space such as by the flow through the gas bearing cavity 44 and out the gas bearing pads 50. The reason is that the entire input of gas into the gas bearing cavity 44 is from the workspace 8, but the gas passing out the gas bearing pads 50 is divided between returning to the workspace and flowing to the back space 43. The cumulative effect of this preferential blow-by over many cycles is that the mean position of the piston creeps in. The mean position of a piston is the center or mid-point between the farthest excursions of the piston in opposite directions. The distance between the farthest opposite excursions of a point on the piston is the piston stroke and one half of the stroke is the piston amplitude of reciprocation.

The engine is provided with a centering system that compensates for this preferential blow-by and prevents the inward creep by the piston 28. The centering system illustrated in FIG. 1 includes a centering system piston passageway 52 (shown in dashed lines) extending from the inner end of the piston boss 36 and out through the sidewall 32 of the piston 28. The centering system also includes an annular groove 56 around the interior wall of the cylinder 22 that opens into the back space 43 through a centering cylinder passageway 54. Whenever the piston passageway 52 and the annular groove 56 come into registration, the centering system provides a gas conducting passageway between the back space 43 and the working space 8. They come into registration twice each cycle, once during each direction of travel of the piston 28. The engine is constructed so that they come into registration to permit gas flow between the back space 43 and the working space 8 when the piston is at or near it's designed mean position. More particularly, the passageway between the back space 43 and the working space 8 is opened whenever the piston is at a position that, if the piston were reciprocating around its designed mean position, the pressure difference between the pressure in the working space 8 and the pressure in the back space 43 at the two times of registration during each cycle would average zero. With zero average pressure difference there would be no net gas flow through the centering system during each cycle. However, if the mean piston position creeps in as a result of gas transfer from the working space 8 to the back space 43, then, at the position of registration, the averaged gas pressure in the back space 43, averaged over the two passings in registration, is greater than the averaged gas pressure in the working space 8 so there is a net gas flow from the back space to the working space. Consequently, if the piston mean position creeps in as a result of the preferential blow-by, gas will be returned from the back space 43 to the working space 8 whenever the gas passageway 52 is opened to the back space 43. Conversely, if the piston were to creep out as a result of transfer of working gas from the back space 43 to the working space 8, then, at the position of registration, the gas averaged pressure in the back space 43 is less than the pressure in the working space 8 so gas will be transferred back from the working space 8 to the back space 43.

Inherent Instability of a FPSE

Most free-piston Stirling engines that are designed according to prior art principles have a typical engine power curve that relates engine power to piston amplitude. FIG. 4 shows a typical power output curve but the scales will vary from machine to machine. Commonly, an FPSE drives an alternator that supplies electrical power to an electrical load although there are useful applications where the engine drives a mechanical load. The instability problem can be considered with regard to an electrical load but is also applicable to mechanical loads.

In the absence of the invention and the absence of a controller, engine power is an increasing exponential function of piston amplitude over the engine's operating range. Typically engine power increases as the square of the engine amplitude. That makes the engine unstable with a linear load, such as a resistive electrical load which varies with voltage squared. Those skilled in the art of Stirling engines are familiar with the typical power curve of FIG. 4.

Considering FIG. 4, if a power curve for a load on the FPSE does not have a greater slope than the power curve for the engine, the engine does not have a stable operating point. The displacer and piston amplitude of reciprocation progressively increase until the piston amplitude of reciprocation increases along the typical power curve beyond the physical stroke limit of the machine at which collision occurs. Because a resistive electrical load has a power curve that, like the engine power curve, varies exponentially as the square of voltage, the slope of the load's power curve does not exceed the slope of the engine's power curve. Consequently, the engine is not stable. This instability means that the engine will not operate around an operating point in response to load variations but instead engine stroke will increase and cause engine damage. This has been called the Achilles heel of the FPSE.

The prior art uses an engine controller to overcome this instability and for additional reasons. The engine controller is commonly interposed between the output of the engine's alternator and input of the ultimate electrical load. Therefore, the controller's input terminals are seen by the output of the engine's alternator as the engine's load. In normal operation the controller prevents the instability and runaway increase in piston and displacer amplitude of reciprocation. Unfortunately, there are occasions when a malfunction of the controller or a disconnection or shorting of a connection between the controller and the FPSE or its alternator causes the load seen by the FPSE to appear as an open circuit or as a short circuit. In either instance there is no load to consume engine power and therefore the conditions for runaway piston amplitude exist. The purpose and object of the invention is to provide simple mechanical modifications of the free-piston Stirling engine that prevent the above-described runaway increase of piston amplitude and engine power despite the occurrence of a malfunction of the type described above.

BRIEF SUMMARY OF THE INVENTION

The invention is a modification of prior art free-piston Stirling engines that causes piston amplitude to be limited and engine power to be reduced as the piston amplitude increases beyond the maximum power that the engine's designer selected when designing the engine. The power output is reduced by reducing the displacer phase with respect to the piston and is further reduced to essentially zero by increasing pumping losses through the engine's gas bearing system.

A first feature of the invention is that the inward edge of the heat rejecter cylinder port is located outward of the most inward excursion of the inward end of the piston sidewall during a part of the reciprocation cycle of the piston. Preferably, the inward edge of the heat rejecter cylinder port is located outward of the most inward excursion of the inward end of the piston sidewall when the engine is operating at a selected maximum engine power for which the engine was designed so that the heat rejecter cylinder port is entirely covered by the piston sidewall during an inward portion of the piston reciprocation when the engine is operating at the selected maximum engine power.

A second feature of the invention is the addition of a leaker port that extends from the gas bearing cavity and through the piston sidewall. The leaker port is positioned axially outward from the gas bearing pads of the engine's gas bearing system. The leaker port is covered by the cylinder when the amplitude of piston reciprocation is equal to or less than the piston's amplitude of reciprocation at maximum engine power and becomes uncovered and in fluid communication with the back space at a piston amplitude of reciprocation that exceeds the piston's amplitude of reciprocation at maximum engine power.

A third feature of the invention is a resilient bumper that is attached to the outward end of the piston or to the inward side of the displacer spring so it is located between the piston and the mechanical spring that is connected to the displacer connecting rod.

With the invention, if the engine load is reduced so that more power is produced by the engine than is consumed by the sum of the power delivered to the load plus the power consumed to drive the engine, then engine power is reduced and piston amplitude is limited as piston amplitude further increases beyond the piston amplitude at the designed maximum engine power.

BRIEF DESCRIPTION OF THE SEVERAL VIEWS OF THE DRAWINGS

FIG. 7 is a diagrammatic and symbolic view in axial cross section of a beta type free-piston Stirling engine that that illustrates a displacer gas cushion that is advantageously combined with the first-described invention but may also be used independently.

FIG. 8 is a diagrammatic and symbolic view in axial cross section of a beta type free-piston Stirling engine that that illustrates an alternative embodiment of a displacer gas cushion that is advantageously combined with the first-described invention but may also be used independently.

Figure 1:
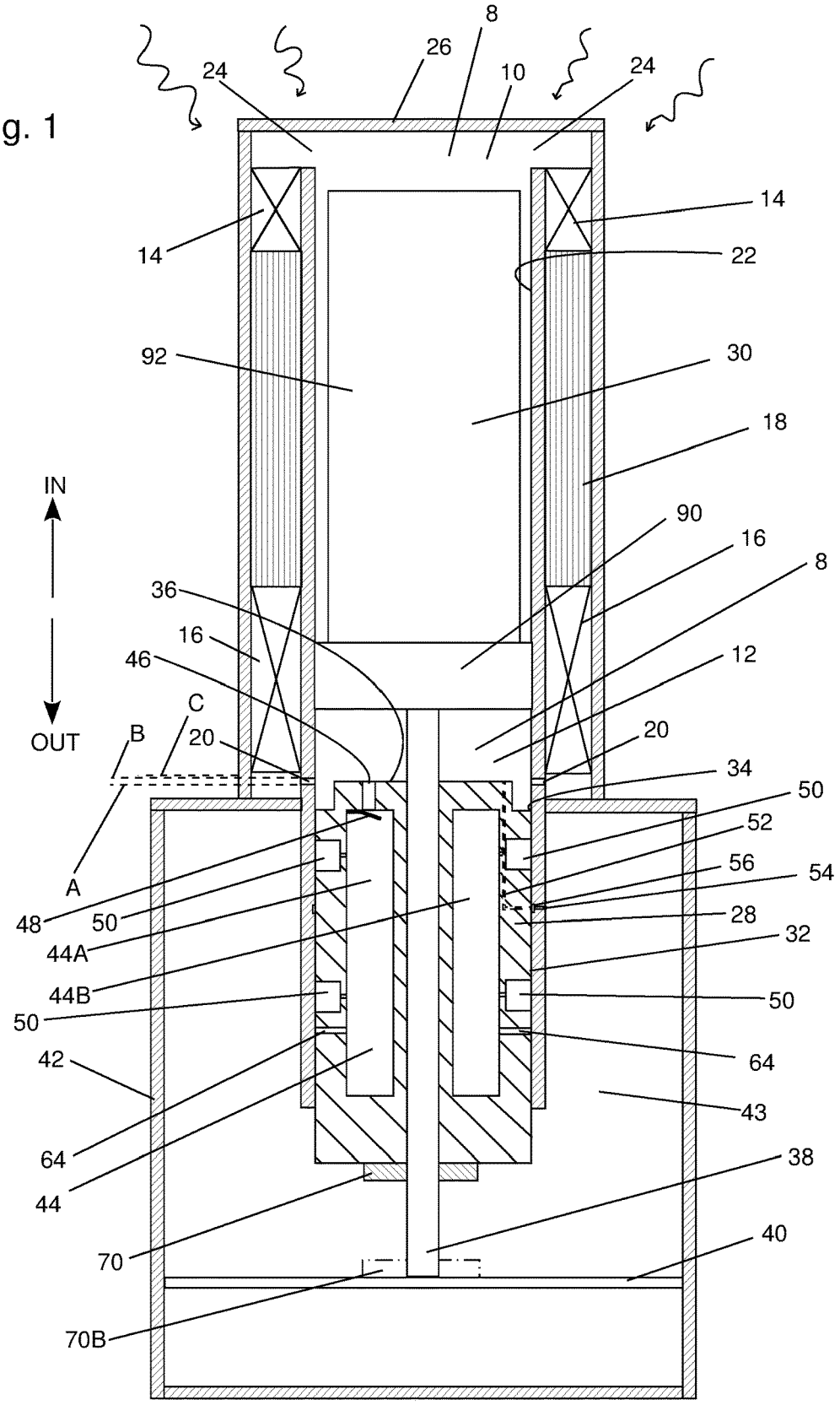
FIG. 1 is a diagrammatic and symbolic view in axial cross section of a beta type free-piston Stirling engine that embodies the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Provisional patent application Ser. No. 62/410,987, filed Oct. 21, 2016 is incorporated in this application by reference.

Covering & Blocking the Heat Rejecter Cylinder Port

The first improvement of the invention is the positioning and location of the heat rejecter cylinder port 20. Unlike the prior art, the heat rejecter cylinder port 20 is positioned where it is covered and blocked by the piston sidewall 32 during a peak part of the piston's inward excursion when the engine power approaches near its maximum designed engine power. Stated another way, the heat rejecter cylinder port 20 is positioned so that, when the piston amplitude of reciprocation is near its amplitude at the engine's peak power, the heat rejecter cylinder port 20 becomes completely covered by the piston sidewall 32 and therefore the passage of gas through the heat rejecter cylinder port 20 becomes blocked. The result of this blockage is that the power curve (FIG. 4), instead of continuing upward exponentially in the manner of a typical power curve, falls below the typical power curve and follows the downward path of the modified power curve of FIG. 4 to an amplitude limit at zero power. In summary, the reason for this downturn of the modified power curve is that blockage of the heat rejecter cylinder port 20 causes the phase lead of the displacer to decrease which results in reduced engine power.

Figure 2:
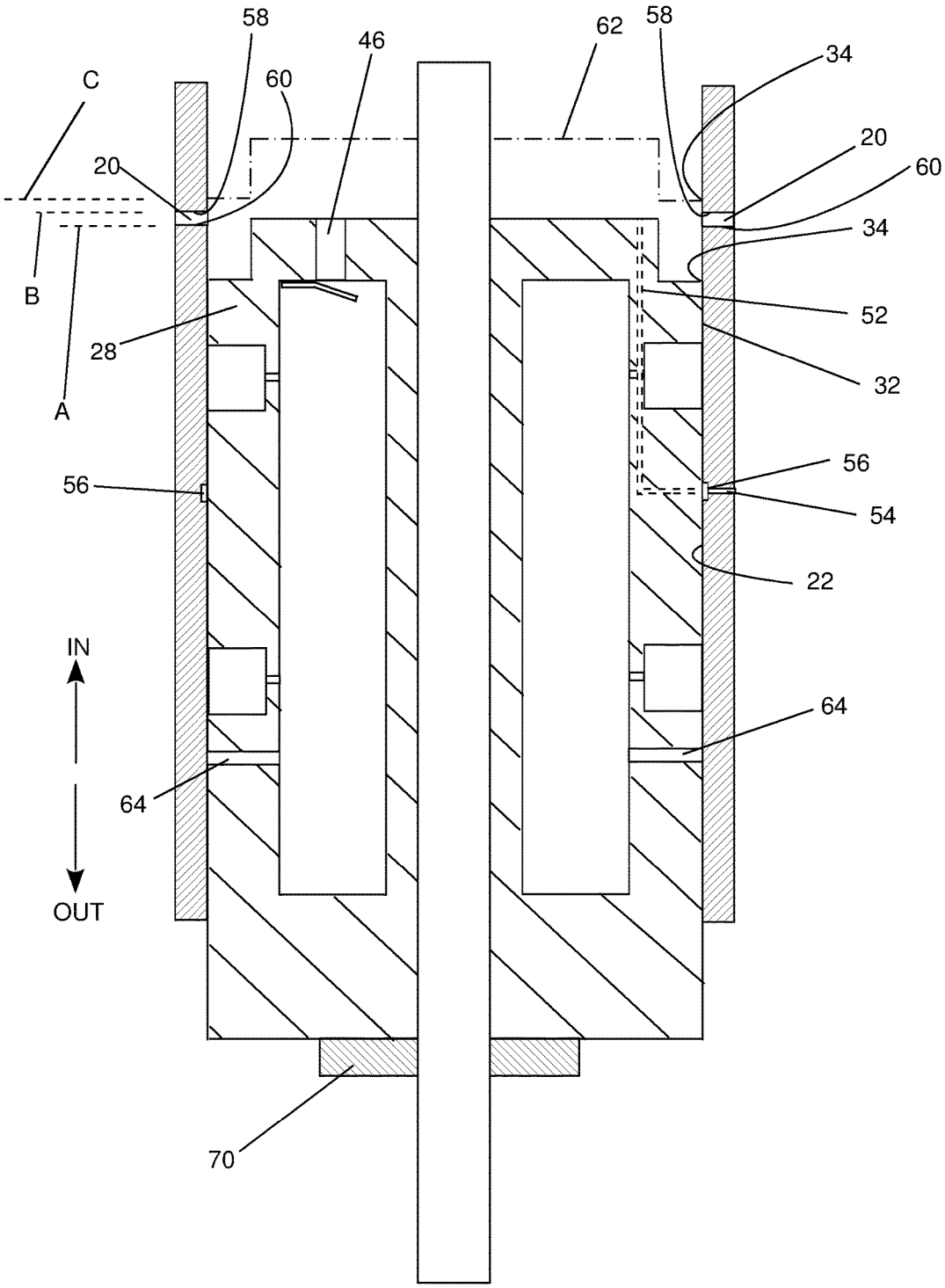
FIG. 2 is a similar and enlarged view of a segment of the engine of FIG. 1 showing in phantom an inward position of the piston.
Figure 4:
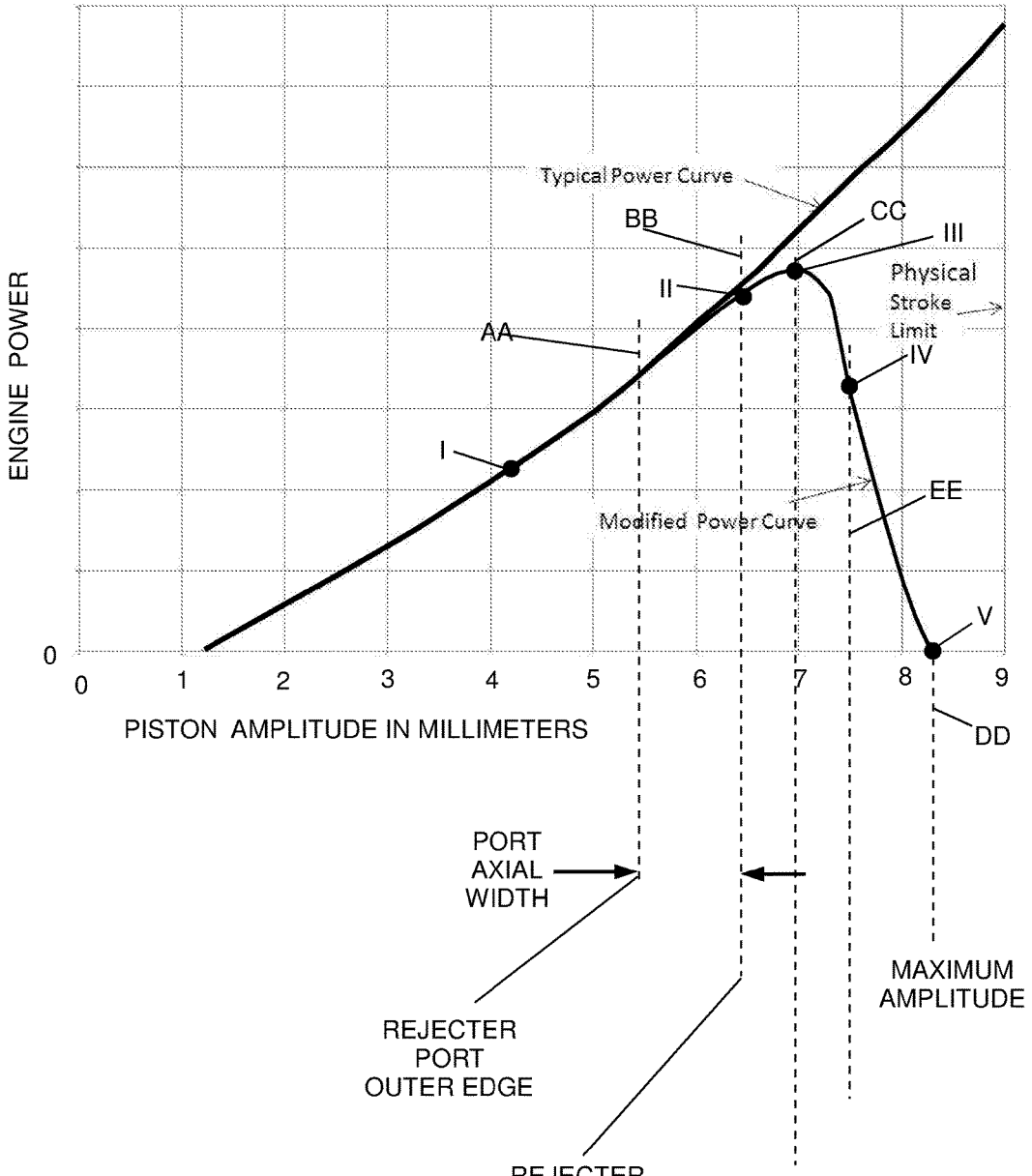
FIG. 4 is a graph showing a typical power curve for an engine of the type illustrated in FIG. 1 and also showing a modified power curve that is the result of implementation of the invention.

Looking at this first improvement of the invention in more detail, the location of the heat rejecter cylinder port 20 is seen with reference to FIGS. 2 and 4. The heat rejecter cylinder port 20 has an inward edge 58 at excursion point B (FIG. 2) for piston amplitude BB (FIG. 4) and an outward edge 60 at excursion point A (FIG. 2) for piston amplitude AA (FIG. 4). In order for the heat rejecter cylinder port 20 to be covered and blocked, the piston 28 must reciprocate inward to at least the excursion point B at which the inward end 34 of the piston sidewall 32 is at the inward edge 58 of the heat rejecter cylinder port 20. At a lesser excursion there is little or negligible effect on the operation of the engine because the heat rejecter cylinder port 20 is not blocked. FIG. 2 shows in phantom an outline of the inward end 62 of the piston 28 when the piston 28 is at its most inward excursion point C and the FPSE is operating at its designed maximum power. At this point, the inward end 34 of the piston sidewall 32 has moved beyond excursion point B to excursion point C (FIG. 2). Consequently, with this first improvement of the invention, the heat rejecter cylinder port 20 is positioned so that the inward edge 58 of the heat rejecter cylinder port 20 is located outward of the most inward excursion of the inward end 34 of the piston sidewall 32 during a part of the reciprocation cycle of the piston 28.

Preferably, the inward edge 58 of the heat rejecter cylinder port 20 is located outward of the most inward excursion of the inward end 34 of the piston sidewall 32 when the engine is operating at a selected maximum engine power for which the engine was designed. That position assures that the heat rejecter cylinder port 20 is entirely covered by the piston sidewall 32 during an inward portion of the piston reciprocation when the engine is operating at its selected maximum engine power. I believe that, more preferably, the inward edge 58 of the heat rejecter cylinder port 20 should be located outward of the most inward excursion of the inward end 34 of the piston sidewall 32 by a distance that is within the range of 3% to 10% of the piston amplitude at maximum engine power. For example, FIG. 4 shows a piston amplitude CC of about 7 mm at the designed maximum operating power. The distance from the most inward excursion of the inward end 34 of the piston sidewall 32 at excursion point C to the inward edge 58 of the heat rejecter cylinder port 20 at excursion point B is about 0.5 mm. The 0.5 mm distance is about 7% of the piston amplitude (7 mm) at maximum power (i.e. piston amplitude CC). The 7% is believed to be most preferred. My best estimate is that the distance should, for the most common FPSEs, be substantially in the range of 0.2 mm to 0.7 mm.

Covering the heat rejecter cylinder port 20 by the piston sidewall 32 during an inward excursion of the piston 28 traps working gas between the outward end of the displacer 30 and inward end of the piston 28. The trapped gas acts as a gas spring between the displacer 30 and the piston 28 because no significant quantity of gas can escape from the volume of space between the piston and displacer. The gas spring applies a relative force between the displacer and piston. When the piston just completes covering the port (i.e. still moving in but nearing the end of its inward excursion), the displacer is moving out. So the piston and displacer are moving closer together in opposite directions of motion. When the piston covers the port and makes the trapped working gas become an effective gas spring, that gas spring is pushing against the outward motion of the displacer which retards the displacer motion and therefore reduces the displacer phase lead ahead of the piston.

Figure 5:
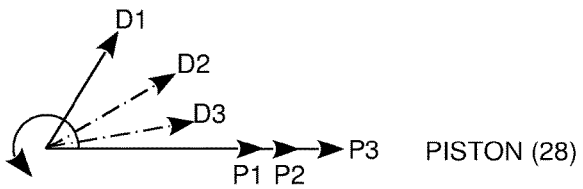
FIG. 5 is a phasor diagram showing the effect of the invention in reducing the phase lead of the displacer ahead of the piston.

FIG. 5 illustrates a common lead of a displacer ahead of a piston. The displacer phasor D1 leads the piston phasor P1 by approximately 60°. However, as the piston amplitude increases to P2 because of the effects of the invention, the displacer phase lead diminishes, for example first to the phase lead of phasor D2, and then, after further increase in piston amplitude to P3, to the phase lead of phasor D3. As known to those skilled in the art, reducing the displacer's phase lead reduces the engine power. The result is that, with the invention, the power curve falls below the typical power curve of FIG. 4 and extends along a modified power curve through points II, III and IV. Consequently, any increase in piston amplitude beyond the amplitude CC at maximum power causes a further reduction of engine power.

There is another effect from covering the heat rejecter cylinder port 20 by the piston sidewall 32 when the piston amplitude of reciprocation is sufficiently large. When the piston amplitude of reciprocation is less than an amplitude that is sufficient to cover the heat rejecter cylinder port 20, the mean position of the piston is maintained by the centering system described above. In that lower range of piston amplitude, the engine is running in the conventional prior art manner so that the mean piston position moves in slightly and increases in piston amplitude result in piston excursions that increase nearly equally in both the in direction and the out direction. However, when the rejecter cylinder port becomes covered and blocked during a part of each cycle, the above-described trapping of gas and the resulting creation of a gas spring applying opposite forces against the displacer and piston has an additional effect on the engine operation. The effect is that most of the further increase in piston amplitude occurs at the outward excursion of the piston and the mean piston position moves out.

Figure 6:
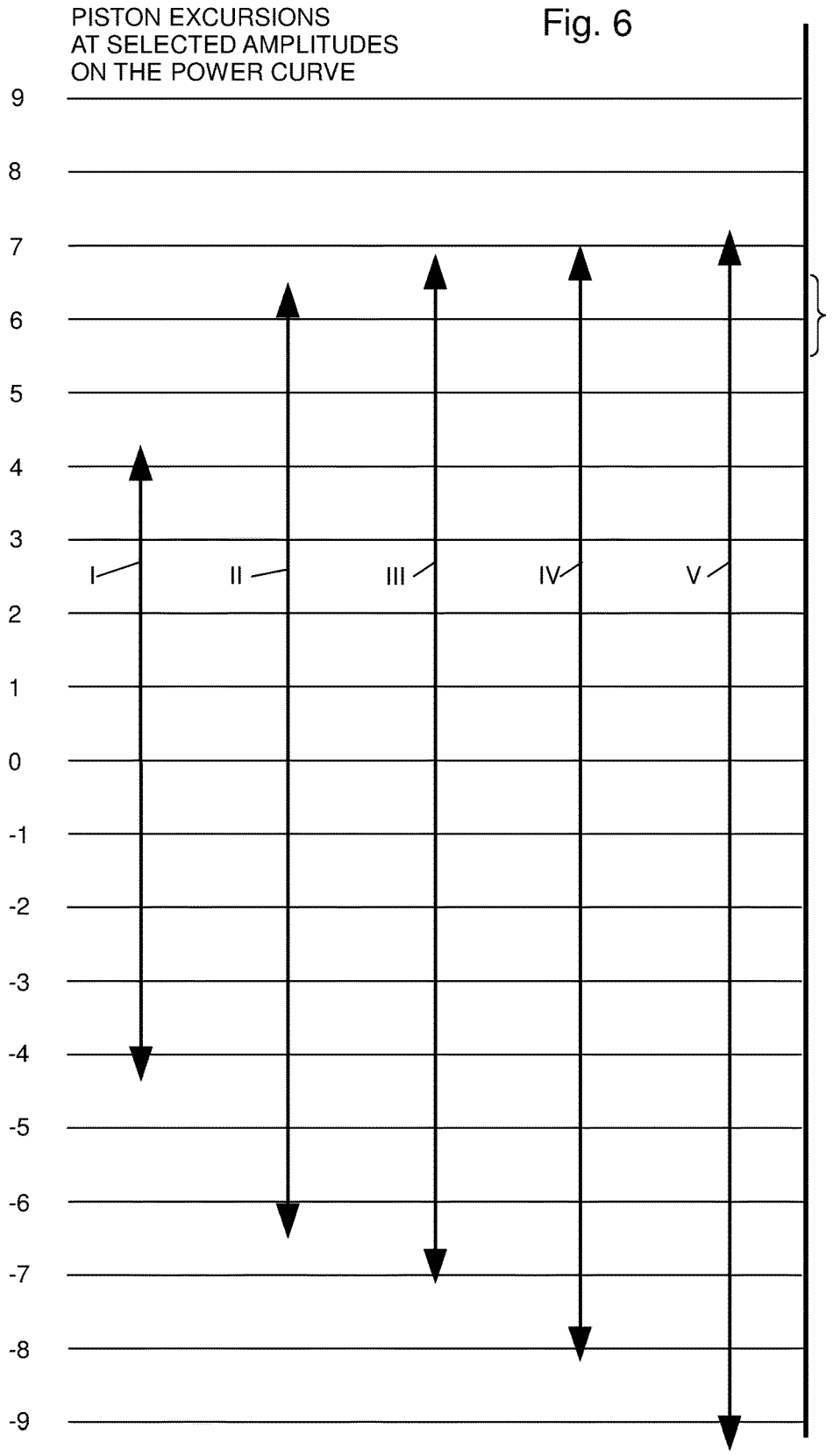
FIG. 6 is graphical diagram illustrating the variation of piston amplitude and piston excursions as piston amplitude increases in an engine that implements the invention.

The reason is as follows. The force applied by the gas spring against the piston exists only when the heat rejecter cylinder port 20 is blocked. That force against the piston is in the outward direction because the displacer is moving out while the heat rejecter cylinder port 20 is blocked. This outward force on the piston causes the mean position of the piston to move outward. The mean piston position moves progressively further away from the working space as the piston amplitude increases. As a result of this outward creep of the mean piston position, as the piston amplitude increases, a greater proportion of the increased amplitude of reciprocation appears as increased excursions in the outward direction than appears as increased excursions in the inward direction. This effect is illustrated in FIG. 6 for points I through V on the power curve of FIG. 4. One consequence of this outward creep of the mean piston position is to help avoid collision between the displacer and piston.

Losses Pumping Gas Through Gas Bearing Cavity

Although the above-described positioning of the heat rejecter cylinder port can be used alone to improve the stability of an FPSE for significantly reduced loads, it reduces the engine power only by at least one third and possibly as much as three fourths from the maximum power. For example, it reduces the engine power at least to approximately the point IV on the modified power curve of FIG. 4. As long as a reduced load absorbs all the engine power produced above the point IV, positioning the heat rejecter cylinder port according to the invention is sufficient. In the portion of the modified power curve before (i.e. above) point IV, the engine power decrease is from the modification of the displacer dynamics by the above-described covering of the rejecter port and thereby retarding the displacer's phase with respect to the piston phase in order to reduce the displacer's lead angle ahead of the piston.

However, this phase lead reduction does not reduce the engine power to zero as the piston amplitude increases still further and beyond (i.e. below) point IV in FIG. 4. If the load is removed entirely or reduced so much that it consumes less engine power than the engine power at point IV, the power curve would turn upward after the point IV and the previously described runaway condition would resume.

In order to reduce the engine power to zero for further increases in piston amplitude beyond point IV, a port is provided in the piston that I have called a "leaker port" 64. As with the other ports, the leaker port 64 can be formed from multiple leaker ports spaced annularly around the piston. The leaker port 64 extends through the piston sidewall 32 and into the gas bearing cavity 44. Preferably the leaker port 64 includes diametrically opposite leaker ports 64 in order to balance side loads on the piston 28.

In summary, the leaker port 64 vents the gas bearing cavity 44 to the back space 43 during sufficiently distant outward piston excursions. This periodic venting causes the additional power, which results from further increases in piston amplitude, to be consumed by pumping losses from pumping working gas around a closed loop and also reduces the amount of power increase as a function of increased stroke by lowering the mean working space pressure as well as operating frequency.

Figure 3:
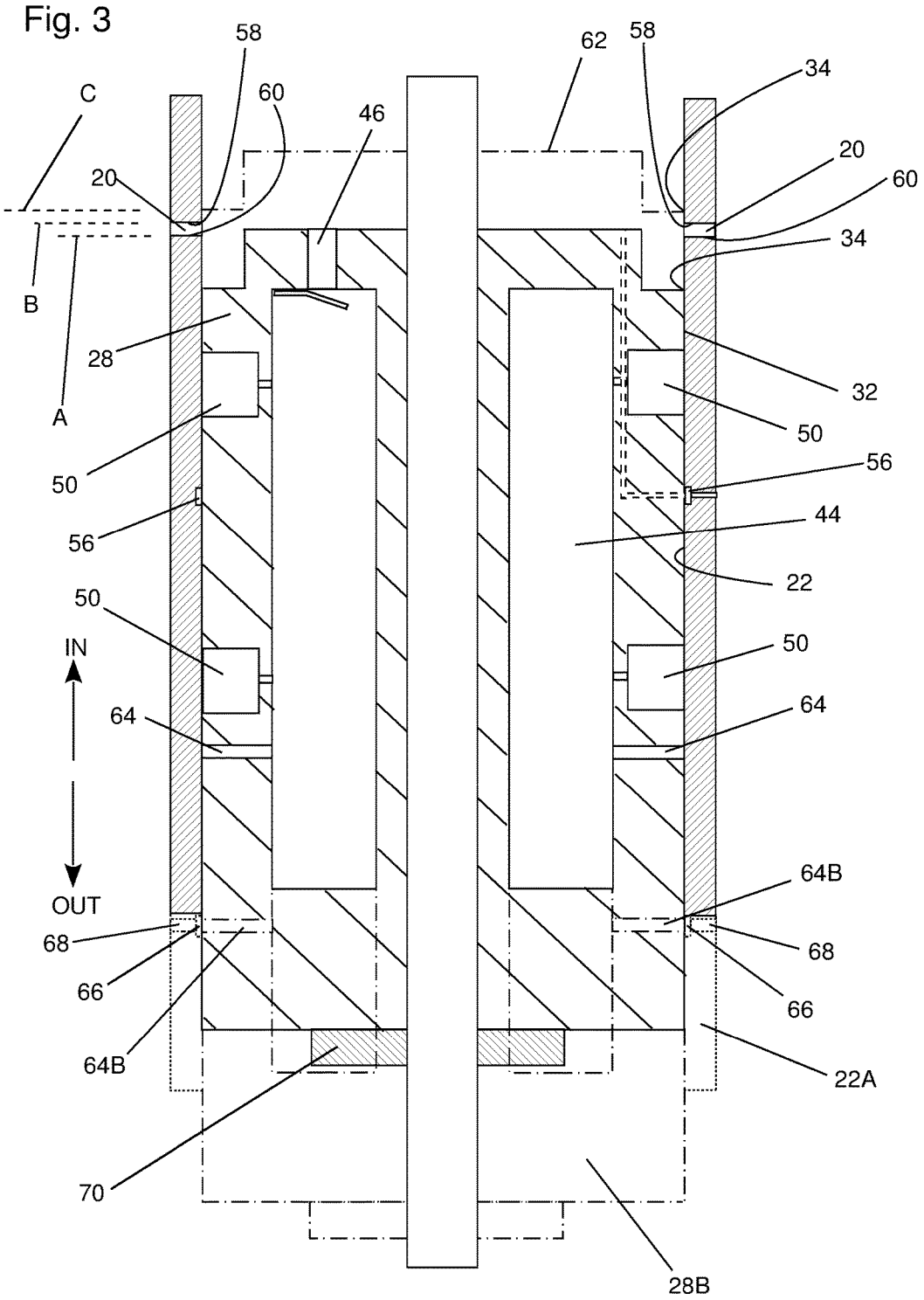
FIG. 3 is also a similar enlarged view of a segment of the engine of FIG. 1 showing in phantom an outward position of the piston.

Referring to FIG. 3, the leaker port 64 is positioned axially outward from the gas bearing pads 50. If the piston 28 makes a sufficiently distant outward excursion to the position 28B, illustrated in phantom, the leaker port 64 moves immediately beyond the end of the cylinder 22 to the position 64B. At position 64B, a gas passage is opened between the gas bearing cavity 44 and the back space 43 (FIG. 1) which allows the venting of working gas from the gas bearing cavity 44 to the back space 43. The gas bearing cavity 44 remains vented through the leaker port 64 to the back space 43 for outward piston excursions that are equal to or greater than piston 28 position 28B. For smaller outward excursions the leaker port 64 is covered by the cylinder 22 so considerably less gas can flow to the back space 43.

During each cycle of engine operation, the gas bearing cavity 44 is charged to peak workspace pressure through its gas bearing inlet passage 46. Consequently, there is a substantial pressure differential between the gas pressure in the gas bearing cavity 44 and the gas pressure in the back space 43. The gas bearing cavity 44 supplies gas out through the gas bearing pads 50 for lubrication purposes as described above. The leaker port 64 is located so that it is typically blocked by the cylinder in normal operation at and below maximum engine power. However, with a piston amplitude increase at least beyond the amplitude at maximum engine power, gas is leaked from the bearing cavity 44 through the leaker port 64 to the back space 43 during a part of each cycle when the piston 28 is at an outer part of its outward excursion. Whenever the leaker port 64 is uncovered, working gas flows directly out of the gas bearing cavity 44 into the back space 43. The substantial pressure differential results in a significant gas flow, during each cycle, from the gas bearing cavity 44 to the back space 43 when the leaker port 46 is not covered by the cylinder 22. As the piston amplitude progressively increases further, the leaker port 46 is uncovered for a longer time so more and more gas is leaked out of the gas bearing cavity 44. During a part of each inward motion of the piston 28 makeup gas is pumped into the gas bearing cavity 44 via the gas bearing inlet passage 46 to recharge the gas bearing cavity 44 to peak cycle workspace pressure.

Referring to FIG. 4, the leaker port 64 is positioned in the axial direction so that the leaker port 64 remains covered by the cylinder 22 when the amplitude of piston reciprocation is equal to or less than the piston's amplitude CC of reciprocation at maximum engine power. The leaker port 64 arrives at the position 64B (FIG. 3) and becomes uncovered and in fluid communication with the back space 43 at a selected piston amplitude of reciprocation that exceeds the piston's amplitude of reciprocation at maximum engine power. Most preferably, the selected piston amplitude at which the leaker port 64 becomes uncovered and in fluid communication with the back space is a piston amplitude EE of reciprocation when the engine power has declined to about two thirds of the maximum engine power, which is at point IV on the modified power curve. Consequently, when the piston amplitude equals or exceeds the amplitude that opens the leaker port 64 to the back space 43, the gas bearing cavity 44 is vented to the back space 43 during a part of each outward excursion of the piston 28. As piston amplitude increases further and the excursions in the outward direction increase, the leaker port 64 increasingly leaks more gas from the gas bearing cavity 44 to the back space 43 because the leaker port 64 is vented to the back space 43 for an increased length of time.

During each cycle of operation that the leaker port 64 becomes uncovered, the quantity of gas that recharges the gas bearing cavity 44 and flows to the back space 43 is considerably greater than the quantity of gas that recharges the gas bearing cavity 44 and flows to the back space 43 during cycles that the leaker port 64 does not become uncovered. Under the latter condition, the only gas flow out of the gas bearing cavity 44 is to supply the gas bearing pads 50. However, during each cycle of operation that the leaker port 64 becomes uncovered, the working gas flow from the working space 8 through the gas bearing cavity 44 and out the leaker port into the back space 43 is large enough that it substantially lowers the mean working space pressure and slightly increases the back space pressure. These pressure changes, which result from opening the leaker port to the back space, cause the averaged back space pressure to be greater than the averaged working space pressure at the times when the centering system passageways come into registration. Therefore, when the centering system passageways come into registration, gas flows out of the back space 43, through the centering system and is returned to the working space 8.

Consequently, when piston amplitude is large enough that the leaker port 64 is being uncovered during a part of each outward reciprocation of the piston, gas is being pumped around a loop. The loop consists of gas pumped by the engine from the working space 8 through the gas bearing cavity 44 and out the leaker port 64 into the back space 43 and gas pumped back in the opposite direction from the back space 43 through the centering system to the working space 8. Pumping the working gas around this loop causes pumping losses. The pumping losses consume energy (work is being done to transport the gas through the passages and their restrictions) thereby reducing engine power because some of the engine power is consumed by the pumping losses. As piston amplitude increases, the leaker port 64 is vented to the back space 43 for a greater angular interval of each cycle. That allows more gas venting which in turn causes more pumping loss until the engine power eventually goes to zero at point V on the modified power curve.

In addition to the pumping losses, the reduction of work space mean pressure (because working gas is flowing from the working space 8 through the gas bearing cavity 44 and out the leaker port into the back space 43) also reduces engine power. The reduced mass of gas in the working space means that the amplitude of gas pressure variations in the working space is reduced so the power to drive the piston and displacer is reduced.

In the description of the first feature of the invention, which allows the heat rejecter cylinder port to be covered, it was explained how the mean piston position moves outward and piston excursions in the outward direction increase more than piston excursions in the inward direction. It can now be seen that moving the piston's mean position in the out direction and increasing the piston's excursions in the out direction also increases the angular interval during each cycle that the leaker port 64 is uncovered. The increased angular interval means that more gas is leaked from the gas bearing cavity 44 to the back space 43 which means that more power is consumed by pumping losses. Increasing the angular interval that the leaker port 64 is uncovered also causes additional lowering of workspace mean pressure and therefore further lowers the power produced by the engine. A still further power reduction also occurs because, with the lowered mean workspace pressure, the frequency decreases in the loss of load case and this also reduces the power produced.

Referring to FIG. 4, the first feature of the invention, covering the heat rejecter cylinder ports, is supplemented by the second feature, causing the pumping losses and lowering the workspace pressure. When piston amplitude initially begins covering the rejecter cylinder port, there is very little if any power loss from the pumping losses. As the leaker port 64 approaches near the cylinder end where it is uncovered, the axial length of the piston-cylinder clearance gap becomes relatively short so there is a small amount of pumping loss as a result of leakage from the leaker port 64 through the short piston-cylinder clearance gap to the back space 43.

As stated above, when piston amplitude increases beyond the piston amplitude at maximum power, about one third to one half of the power reduction from the present invention is the result of covering and blocking the rejecter cylinder port with the piston sidewall. Therefore, the leaker port 64 should start to be uncovered at a piston amplitude that is about one third of the way down (point IV) on the modified power curve. As piston amplitude increases further, power reduction, from pumping losses and from lowering the workspace pressure, increases until its maximum reduction when the engine power goes to zero at piston amplitude DD at point V.

It is not necessary that the leaker port 64 be vented to the back space 43 by moving below the end of the cylinder 22. Alternatively, the cylinder can extend further to cylinder extension 22A, as illustrated in dashed lines in FIG. 3. The cylinder extension 22A can be provided with an annular cylindrical groove 66 connected to a cylinder passageway 68 that opens at its opposite ends into a groove 66 and the back space 43. Multiple such passageways 68 can be spaced annularly around the cylinder all providing a passageway between the annular groove 66 and the back space 43.

Also it is not necessary that the leaker port have a particular configuration. It is, of course, desirable to maintain lubrication of the piston sidewall 32. So a designer would want to maintain a number and placement of the gas bearing pads that provide appropriate lubrication according to prior art engine design principles. If a bearing pad, which is constructed to provide adequate lubrication according to those principles, moves immediately beyond the end of the cylinder 22 or otherwise opens a gas passage between the gas bearing cavity 44 and the back space 43, its lubrication function is lost. In fact, as a bearing pad approaches close to the end of the cylinder, its lubrication function is somewhat degraded. For that reason it is undesirable to have a gas bearing pad, which is used to provide lubrication, move beyond the end of the cylinder 22. However, it is not necessary that a leaker port be a simple cylindrical hole. A leaker port can have other shapes that provide a gas passage extending through the piston sidewall 32 and into the gas bearing cavity 44. Among the other possible configurations of the leaker port is the configuration of a gas bearing pad. In other words, a leaker port can be provided that is made to look like a gas bearing pad but is included to function as a leaker port.

BUMPER. A third feature of the invention that improves loss of load operation is to include a bumper 70 that limits the relative inward motion of the displacer with respect to the piston. The bumper limits displacer relative motion (motion relative to the piston) by striking the planar spring 40 and thereby pushing the displacer connecting rod, and therefore the displacer, in the out direction. The bumper 70 is a soft or resilient material that is attached to the outward end of the piston or the inward side (70B) of the planar spring 40 and cushions and dampens any collision between the piston and the planar spring 40 that is fixed to the end of the displacer connecting rod 38. Any contact of the bumper 70 with the planar spring 40 would be relatively soft or glancing in nature because the displacer phase angle has been reduced greatly by power limiting effects of one or both of the first two above-described features of the invention. The bumper is intended to contact the displacer spring and thereby limit displacer motion relative to the piston. This limit of relative motion of the displacer away from the piston also helps to reduce power growth during overstroke. Typically this bumper is not needed but in certain arrangements, such as operation with a tuned vibration absorber, it provides added protection. As described above, the closure of the heat rejector cylinder port by the piston sidewall effectively limits the relative motion of displacer toward the piston. The bumper has the same effect in the opposite direction making it desirable for use with the tuned vibration absorber. With the absorber, casing motion will increase when the engine frequency changes. This in turn inputs energy to drive the displacer to a larger amplitude.

Those skilled in the art are capable of designing a free-piston Stirling engine to have a selected amplitude under the operating conditions of their choice. Of course engineering design is not perfected to the extent that a prototype always operates exactly according to its design parameters. So persons skilled in the art can build a prototype engine, test it and then modify its design to obtain the design parameters they want. Repetition of the design, build, test and modify procedure is a common iterative process that eventually leads to a desired operation.

One way to design an engine using one or more of the features of the invention is to begin with a graph of an engine's typical power curve known in the prior art. The designer would then estimate, on the same graph, what the modified power curve created by the invention would be for a particular engine design and its chosen parameters. Engine amplitude at zero power on the modified power curve is the allowed amount of piston amplitude. The designer can estimate or choose the piston amplitude CC at the peak of the modified power curve (FIG. 4) and the maximum excursion point C (FIG. 2) of the end 34 of the piston sidewall 32 at the peak of the modified power curve (FIG. 4). The rejecter cylinder port 20 becomes covered by the end 34 of the piston sidewall 32 when the end 34 of the piston sidewall 32 arrives at excursion point B (FIG. 2). This full covering of the rejecter cylinder port 20 occurs preferably at 3% to 10% of the piston stroke before maximum power. Therefore, the inner edge 58 of the rejecter cylinder port 20 should be positioned outward from excursion point C by a distance of 3% to 10% of the piston stroke CC at maximum power.

The leaker port location is then chosen so that the leaker port opens to the back space at a piston amplitude on the down side of the estimated power curve, preferably at least one third of the way down. A prototype is then constructed and tested and the power curve for the prototype can be generated. From that design modifications are made, such as relocation of the centering system, the rejecter port and/or the leaker port.

DISPLACER GAS CUSHION. FIGS. 7 and 8 illustrate another improvement which can serve one or both of two purposes. One purpose is to limit the excursions of the displacer in order to prevent the end 88 of the displacer 30 from striking the hot head end 26 of the engine. The other purpose is to provide additional stroke limiting and damping in order to help limit engine power and help prevent the instability and runaway increase in piston and displacer amplitude of reciprocation that are described above.

FIGS. 7 and 8 are views of the top portion of a FPSE like that illustrated in FIG. 1 but incorporating two embodiments of a displacer gas cushion. In both FIGS. 7 and 8 the heat accepter cylinder port 24 is spaced from the head (sometimes called the dome) end 26 of the expansion space 10. A displacer gas cushion 72 is formed at the expansion space 10 and has a cushion cylinder 74 axially aligned with the engine cylinder 22. The gas cushion 72 is for receiving an end of the displacer 30 if the reciprocating displacer 30 makes a sufficiently large excursion and enters the gas cushion cylinder 74. The cushion cylinder 74 is at the head end of the engine cylinder 22 and preferably attached or otherwise forced into contact with the head end 26. The cushion cylinder 74 has a cushion cylinder wall 76 that extends between the head end 26 and the heat accepter cylinder port 24 so that the displacer covers the heat accepter cylinder port 24 if the displacer reciprocates into the cushion cylinder 74.

The cushion cylinder 74 has a larger diameter than the end portion of the displacer 30 in order to provide a clearance gap between the displacer 30 and the cushion cylinder 74 that is sufficient to prevent the displacer 30 from striking or rubbing the cushion cylinder 74 and for permitting gas flow blow-by to provide pumping losses for damping displacer motion. The displacer 30 typically has a Heylandt crown (hot cap) which is smaller than the engine cylinder 22 to provide the clearance gap. However, the cushion cylinder 74 diameter should be larger than the displacer diameter if the displacer diameter is equal to the diameter of the engine cylinder 22. Preferably, the axial length 78 of the cushion cylinder 74 from the head end 26 of the expansion space 10 to the heat accepter cylinder port 24 is in the range of 5% to 10% of the displacer stroke.

FIG. 8 shows a functionally similar embodiment. A displacer gas cushion 80 is formed at the expansion space 10 and has a cushion cylinder 82 axially aligned with the engine cylinder 22 for receiving an end of the displacer 30. The cushion cylinder 82 is conveniently formed in an extended end portion of the engine cylinder 22 and has a cushion cylinder wall 84 that extends to the head end 26 of the Stirling engine. As on alternative structure, the cushion cylinder can be a separate cylindrical part that is held by a shorter engine cylinder 22 against the head end 26. The separate cylindrical part can be either axially long enough to include the heat accepter cylinder ports 24 or axially short enough to not include the heat accepter cylinder ports 24.

The cushion cylinder 82 also has a larger diameter than the end portion of the displacer 30 in order to provide a clearance gap between the displacer 30 and the cushion cylinder 82 that is sufficient to prevent the displacer 30 from striking or rubbing the cushion cylinder 82 and for permitting gas flow blow-by to provide pumping losses for damping displacer motion. As with the embodiment of FIG. 7, the displacer 30 ordinarily has a Heylandt crown (hot cap) which is smaller than the engine cylinder 22 to provide the clearance gap. However, the cushion cylinder 82 diameter should be larger than the displacer diameter if the displacer diameter is equal to the diameter of the engine cylinder 22. Preferably, the axial length 86 of the cushion cylinder 82 from the head end 26 of the expansion space 10 to the heat accepter cylinder port 24 is in the range of 5% to 10% of the displacer stroke.

The displacer gas cushion operates to close off a space, which is a portion of the expansion space 10, by blocking the heat acceptor cylinder ports 24. The space within the cushion cylinder 76 or 82 is sufficiently sealed so that, when the heat acceptor cylinder ports 24 are blocked by the displacer, the space within the cushion cylinder 76 or 82 functions as a gas spring. For example, the cushion cylinder 82 does not have to be perfectly or completely sealed against the head end 26 and a small amount of leakage could be desirable to provide additional pumping losses. The cushion cylinder 76 or 82 needs only to be sufficiently sealed so that, when the end 88 of the displacer 30 covers the heat acceptor cylinder ports 24 and reciprocates into the cushion cylinder 74 or 82, as shown in phantom as displacer end 88A, the working gas within the cushion cylinder 76 or 82 is compressed and applies a retarding force against the displacer end 88. The retarding force is a combination of a damping component and a spring component, although primarily spring component. The retarding force prevents the displacer end 88 from colliding with the head end 26. This also has a limiting effect on the displacer stroke and therefore has a limiting effect on the mass of working gas that is periodically shuttled back and forth through the regenerator. The consequent result is that the displacer cushion also has some limiting effect on the piston stroke.

Previously explained is the manner in which covering and blocking the heat rejecter cylinder port and causing losses pumping gas through gas bearing cavity are used to limit engine power and prevent the instability of and the runaway increase in piston and displacer amplitude of reciprocation. The displacer gas cushion can further assist in that purpose. Therefore, the displacer gas cushion is desirably used with either or both embodiments of those previously explained concepts. The displacer gas cushion can also be used alone, especially where it is desired to prevent the displacer from colliding with the engine head or dome.

Although a displacer can have a uniform diameter along its entire axial length, as seen in FIG. 1 a displacer typically has a seal segment 90 and a non-seal segment 92 which is axially longer and has a smaller diameter than the seal segment 90. The clearance gap between the cushion cylinder wall 76 or 84 and the non-seal segment 92 of the displacer 30 is larger than the clearance gap between the seal segment 90 and the cylinder in which the displacer reciprocates. Consequently, the displacer 30 can tilt slightly away from axial alignment in its cylinder as a result of side loads. It would be undesirable if the end 88 of the displacer 30 were to strike the cushion cylinder 74 or 82 or if the sidewall that surrounds the displacer end 88 were to rub against the cushion cylinder wall 76 or 84. The cushion cylinder 74 or 82 is constructed sufficiently larger in diameter than the cylinder in which the displacer reciprocates, which is usually the engine cylinder 22, in order to avoid such striking or rubbing. That relationship of the diameters is also desirable in order to have some blow-by leakage through the clearance gap in order to provide damping as a result of pumping losses from gas moving axially through the clearance gaps between the displacer 30 non-seal segment 92 and the cushion cylinder wall 76 or 84. This pumping loss damping from the displacer gas cushion provides some further damping for the same purpose as explained above in connection with losses by pumping gas through the gas bearing cavity. Although the purpose may be the same, they will normally be quantitatively different.

REFERENCE LIST working space 8
heat accepting expansion space 10
heat rejecting compression space 12
heat acceptor 14
heat rejecter 16
regenerator 18
heat rejecter cylinder port 20
engine cylinder 22
heat acceptor cylinder port 24
entire head end 26
piston 28
displacer 30
piston sidewall 32
inward end 34 of piston sidewall 32
boss 36
displacer connecting rod 38
planar spring 40
casing 42
large volume back space 43
gas bearing cavity 44, 44A and 44B
gas bearing inlet passage 46
check valve 48
gas bearing pads 50
centering system piston passageway 52
centering system cylinder passageway 54
centering system annular cylinder groove 56
inward edge 58 of rejecter cylinder port 20
outward edge 60 of rejecter cylinder port 20
inward end 62 of piston 28
leaker port 64
leaker port 64 in position 64B when piston in outward excursion
groove 66 for alternative leaker port 64 vent to back space 43
passageway 68 for alternative leaker port 64 vent to back space 43
bumper 70
displacer gas cushion 72 (FIG. 7)
cushion cylinder 74 (FIG. 7)
cushion cylinder wall 76 (FIG. 7)
axial length 78 of cushion cylinder 74 (FIG. 7)
displacer gas cushion 80 (FIG. 8)
cushion cylinder 82 (FIG. 8)
cushion cylinder wall 84 (FIG. 8)
axial length 86 of cushion cylinder 80
end 88 of displacer 30
seal segment 90 of displacer 30
non-seal segment 92 of displacer 30

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A method for limiting engine power and piston amplitude of reciprocation of a free-piston Stirling engine, the engine including a displacer and a piston mounted for reciprocation within a cylinder, the piston having a sidewall engaging the cylinder and the sidewall having an inward end, the engine including a heat rejecter cylinder port through the engine cylinder at a compression space end of a working gas flow path between a heat accepting expansion space and an opposite heat rejecting compression space, the heat rejecter cylinder port having an inward edge, wherein the method comprises:

(a) positioning the inward edge of the heat rejecter cylinder port outward of the most inward excursion of the inward end of the piston sidewall; and (b) entirely covering the heat rejecter cylinder port by the piston sidewall during a peak part of the inward piston reciprocation; and (c) wherein the engine has a back space and a gas bearing system including a gas bearing cavity enclosed within the piston, a gas bearing inlet passage extending between the cavity and an inward end of the piston and gas bearing pads opening into the cavity and formed around the sidewall of the piston, and wherein the method further comprises opening a passage between the cavity and the back space during a part of outward excursions of the piston when the amplitude of piston reciprocation becomes a selected piston amplitude that exceeds the amplitude of reciprocation at maximum engine power.

2. A method according to claim 1 wherein said passage is a leaker port from said gas bearing cavity through the piston sidewall and the method further comprises covering the leaker port by the cylinder when the amplitude of piston reciprocation is equal to or less than the piston's amplitude of reciprocation at maximum engine power and uncovering the leaker port and connecting the leaker port in fluid communication with the back space at a selected piston amplitude of reciprocation that exceeds the piston's amplitude of reciprocation at maximum engine power.

3. A free-piston Stirling engine according to claim 2 wherein the selected piston amplitude at which the leaker port becomes uncovered and in fluid communication with the back space is a piston amplitude of reciprocation when the engine power has declined at least down to two thirds of the maximum engine power.

* * * * *